US007288882B1

(12) United States Patent
Kiermaier

(10) Patent No.: US 7,288,882 B1
(45) Date of Patent: Oct. 30, 2007

(54) LAMP ELECTRODE AND METHOD FOR DELIVERING MERCURY

(75) Inventor: Ludwig P. Kiermaier, Edison, NJ (US)

(73) Assignee: E.G.L. Company Inc., Berkeley Heights, NJ (US)

( * ) Notice: Subject to any disclaimer, the term of this patent is extended or adjusted under 35 U.S.C. 154(b) by 0 days.

(21) Appl. No.: 11/678,257

(22) Filed: Feb. 23, 2007

Related U.S. Application Data

(63) Continuation of application No. 11/522,547, filed on Sep. 14, 2006, which is a continuation-in-part of application No. 11/376,576, filed on Mar. 16, 2006.

(51) Int. Cl.
*H01J 61/28* (2006.01)

(52) U.S. Cl. ..... 313/490; 313/558; 313/559; 313/565

(58) Field of Classification Search ..... 313/490, 313/558, 559, 565–566, 552, 554, 556
See application file for complete search history.

(56) References Cited

U.S. PATENT DOCUMENTS

| | | | | |
|---|---|---|---|---|
| 2,280,618 | A | 4/1942 | Besson | 176/125 |
| 2,283,189 | A | 5/1942 | Cox | 176/126 |
| 2,288,253 | A | 6/1942 | Reuter | 250/27.5 |
| 2,322,421 | A | 6/1943 | Cox | 176/7 |
| 2,415,895 | A | 2/1947 | Lopez | 316/14 |
| 2,991,387 | A | 7/1961 | McCauley | 313/109.5 |
| 3,297,898 | A | 1/1967 | Dobbins | 313/174 |
| 3,300,037 | A | 1/1967 | De Santis | 206/0.4 |
| 3,657,589 | A | 4/1972 | Della Porta et al. | 7/18 |
| 3,684,345 | A | 8/1972 | Schiekel et al. | 316/4 |
| 3,728,004 | A | 4/1973 | Waymouth | 316/4 |
| 3,764,842 | A | 10/1973 | Ridders et al. | 313/177 |
| 3,794,402 | A | 2/1974 | Ridders et al. | 316/14 |
| 3,895,709 | A | 7/1975 | Pryzbylek | 206/84 |
| 3,898,511 | A | 8/1975 | Johnson et al. | 313/490 |
| 3,898,720 | A | 8/1975 | Morehead | 29/25.13 |
| 3,913,999 | A | 10/1975 | Clarke | 316/4 |
| 3,957,328 | A | 5/1976 | van der Wolf et al. | 316/3 |
| 3,983,439 | A | 9/1976 | Blommerde et al. | 313/174 |
| 4,020,378 | A | 4/1977 | Morehead | 313/174 |
| 4,056,750 | A | 11/1977 | Latassa | 313/177 |
| 4,105,910 | A | 8/1978 | Evans | 313/490 |

(Continued)

FOREIGN PATENT DOCUMENTS

| | | | |
|---|---|---|---|
| CA | 2133509 | 4/1995 | |
| EP | 63393 | 6/1986 | 61/28 |
| EP | 161725 | 3/1989 | 9/395 |
| GB | 1419098 | 12/1975 | 7/189 |
| GB | 1475458 | 6/1977 | 61/28 |

*Primary Examiner*—Karabi Guharay
(74) *Attorney, Agent, or Firm*—Thomas L. Adams

(57) ABSTRACT

A lamp electrode adapted to deliver mercury during an assembly process has a supporting electrical lead attached to the proximal end of a metallic shell. The proximal and a distal ends of the metallic shell each lie along a central axis. A container with a vitreous plug in a sealed end contains a substance for delivering mercury upon heating of the container. The sidewall of the container is attached to the electrical lead. The longitudinal axis of the container is skewed relative to the electrical lead to orient the container in a direction to reduce discharge of mercury directly toward the metallic shell. The container is heated to open it and discharge a mercury dose from the sealed end, which is prone to opening upon heating of the container.

19 Claims, 4 Drawing Sheets

U.S. PATENT DOCUMENTS

| | | | | |
|---|---|---|---|---|
| 4,145,634 | A | 3/1979 | Evans et al. | 61/28 |
| 4,182,971 | A | 1/1980 | Cassidy et al. | 313/177 |
| 4,282,455 | A | 8/1981 | Latassa et al. | 313/177 |
| 4,288,715 | A | 9/1981 | van Overveld et al. | 313/174 |
| 4,308,650 | A | 1/1982 | Hernandez et al. | 29/25 |
| 4,335,326 | A | 6/1982 | Latassa et al. | 313/177 |
| 4,393,325 | A | 7/1983 | van der Kooi | 313/552 |
| 4,499,400 | A | 2/1985 | Anderson et al. | 313/265 |
| 4,528,209 | A | 7/1985 | Anderson et al. | 427/67 |
| 4,534,742 | A | 8/1985 | Grossman et al. | 445/9 |
| 4,539,508 | A | 9/1985 | Mulder et al. | 313/546 |
| 4,553,067 | A | 11/1985 | Roche et al. | 313/546 |
| 4,691,141 | A | 9/1987 | Buhrer et al. | 313/565 |
| 4,698,549 | A | 10/1987 | Hammer et al. | 313/490 |
| 4,754,193 | A | 6/1988 | Holmes et al. | 313/490 |
| 4,767,965 | A | 8/1988 | Yamano | 313/491 |
| 4,808,136 | A | 2/1989 | Schuster | 445/9 |
| 4,823,047 | A | 4/1989 | Holmes et al. | 313/546 |
| 4,870,323 | A | 9/1989 | Parks, Jr. et al. | 313/546 |
| 4,907,998 | A | 3/1990 | Kuijer et al. | 445/9 |
| 4,924,145 | A | 5/1990 | Buschmann | 313/546 |
| 5,022,882 | A | 6/1991 | White et al. | 445/21 |
| 5,057,743 | A | 10/1991 | Krasko et al. | 313/639 |
| 5,200,233 | A | 4/1993 | Mohacsi | 427/64 |
| 5,237,240 | A | 8/1993 | Bouchard | 313/550 |
| 5,256,935 | A | 10/1993 | Dobashi et al. | 313/491 |
| 5,278,473 | A | 1/1994 | Parks, Jr. et al. | 313/546 |
| 5,294,867 | A | 3/1994 | Grossman | 313/490 |
| 5,387,837 | A | 2/1995 | Roelevink et al. | 343/484 |
| 5,394,056 | A | 2/1995 | Forman et al. | 313/547 |
| 5,434,482 | A | 7/1995 | Borowiec et al. | 315/248 |
| 5,629,584 | A | 5/1997 | Borowiec et al. | 313/565 |
| 5,739,633 | A | 4/1998 | Biro et al. | 313/490 |
| 5,751,110 | A | 5/1998 | Spaapen et al. | 313/550 |
| 5,754,000 | A | 5/1998 | Skilton et al. | 313/565 |
| 5,801,482 | A | 9/1998 | Verhaar et al. | 313/483 |
| 5,814,936 | A | 9/1998 | Martinet | 313/545 |
| 5,841,220 | A | 11/1998 | Ooms | 313/565 |
| 5,912,536 | A | 6/1999 | Michiels et al. | 315/248 |
| 5,917,276 | A | 6/1999 | Traksel et al. | 313/490 |
| 5,994,837 | A | 11/1999 | Willwms et al. | 313/550 |
| 6,048,241 | A | 4/2000 | Traksel et al. | 445/9 |
| 6,137,236 | A | 10/2000 | Michiels et al. | 315/248 |
| 6,201,347 | B1 | 3/2001 | Smulders | 313/547 |
| 6,222,318 | B1 | 4/2001 | Oomen et al. | 313/613 |
| 6,304,029 | B1 | 10/2001 | De Bot et al. | 313/490 |
| 6,369,503 | B1 | 4/2002 | Tuttle et al. | 313/490 |
| 6,719,600 | B2 | 4/2004 | Grossman et al. | 445/9 |
| 2003/0020406 | A1* | 1/2003 | Kiermaier | 313/625 |

* cited by examiner

LAMP ELECTRODE AND METHOD FOR DELIVERING MERCURY

BACKGROUND OF THE INVENTION

1. Field of the Invention

The present invention relates to lamp electrodes adapted to deliver mercury and to methods for delivering mercury to a lamp.

2. Description of Related Art

Conventional gaseous discharge lamps employ a metallic electrode in the form of a tubular shell that is open at the distal end and closed at the proximal end. The proximal end of the shell is supported at the hairpin turn of supporting electrical leads, whose two legs are embedded in a pinch seal made in a short tubular glass body. A working discharge lamp is typically fabricated in the field by fusing the short glass tubes of the electrode assemblies to both ends of a longer glass tube that was internally coated with a phosphorescent material.

An evacuation tube can be included as part of one of the electrode assemblies in order to communicate with the interior of the discharge lamp. Before loading fill gases into the lamp, the electrode shells are bombarded with charged particles in the usual fashion in a partial vacuum. Thereafter, working with the evacuation tube, a vacuum is pulled before loading an inert gas and tipping off the evacuation tube.

For the sake of efficiency a discharge lamp will typically have a dose of mercury. During normal operation the mercury atoms (existing as a vapor in the lamp) are stimulated by an electrical discharge between the two electrodes and emit UV radiation when returning to a lower energy state. This UV radiation will stimulate the phosphorescent coating on the inside of the long glass tube to produce visible light.

While mercury has its benefits it is also a toxic substance and care must be taken to avoid injury and to ensure accurate dosing. It is especially desirable to avoid handling mercury in the field or relying on the measurement skill of field personnel to ensure correct mercury dosing.

In addition, care must be taken to contain the mercury to avoid an accidental release into the environment, which can adversely affect water quality, fish, and wildlife. It has been determined that containment and safety is enhanced if the mercury is confined to a small container until the discharge lamp is fully sealed, at which point the mercury container can be opened to release the mercury dose.

Also, care must be taken to avoid a premature discharge of mercury before the lamp is completely sealed. The mercury container can prematurely open when exposed to the high temperatures that are often experienced during the manufacture of electrodes and during the fabrication of a working discharge lamp in the field. For example, during the manufacture of electrodes one end of a relatively short glass tube is melted to form a pinch seal on the leads. During fabrication in the field, before the lamp is fully sealed, the electrode shell are "bombarded" with a high current and heated glowing red When release of the mercury is desired, such release ought to be reliable without risking damage to the finished lamp. Furthermore, the mercury should be released in a location and in a direction to ensure the mercury will be available while avoiding condensation that may stain lamp components and degrade their appearance.

Miniature movement-detection switches have employed a small container sealed with a header. A drop of liquid mercury in the container can make a connection between the metal container and a lead projecting into the container through an insulating glass feedthrough in the header. See the miniature switches offered by Comus International; Clifton, N.J.

SUMMARY OF THE INVENTION

In accordance with the illustrative embodiments demonstrating features and advantages of the present invention, there is provided a lamp electrode adapted to deliver mercury during an assembly process. The electrode has an electrode subassembly with a metallic shell, a supporting electrical lead, and a vitreous tube. The metallic shell has a proximal end and a distal end each lying along a central axis. The supporting electrical lead is attached to the proximal end of the metallic shell. The vitreous tube is fused onto the electrical lead to surround the shell. The lamp electrode also has a container with a side wall, a sealed end, and a longitudinal axis. The container contains a substance for delivering mercury upon heating of the container. The container is attached to the electrode subassembly and spaced proximally from the metallic shell. The longitudinal axis of the container is skewed relative to the central axis to orient the container in a direction to reduce discharge of mercury directly toward the metallic shell.

According to another aspect of the invention, there is provided a lamp electrode adapted to deliver mercury during an assembly process. The electrode has an electrode subassembly with a metallic shell, a supporting electrical lead and a vitreous tube. The metallic shell has a proximal end and a distal end each lying along a central axis. The supporting electrical lead is attached to the proximal end of the metallic shell. The vitreous tube is fused onto the electrical lead to surround the shell. The electrode also includes a container containing a substance for delivering mercury upon heating of the container. This container has a sealed end with a vitreous plug. The container is supported on the electrode subassembly.

According to yet another aspect of the invention, there is provided a lamp electrode adapted to deliver mercury during an assembly process. The electrode has an electrode subassembly with a metallic shell, a supporting electrical lead and container. The metallic shell has a proximal end and a distal end, each lying along a central axis. The supporting electrical lead is attached to the proximal end of the metallic shell. The a vitreous tube is fused onto the electrical lead to surround the shell. The electrode also includes a container spaced proximally from the shell. The container has a sidewall, a sealed end, and a longitudinal axis. This container contains a substance for delivering mercury upon heating of the container. The container is supported by the electrode subassembly, and its sealed end is prone to opening upon heating of the container. The container is oriented in a direction to reduce discharge of mercury directly toward the metallic shell.

According to still yet another aspect of the invention, there is provided a method for releasing a dose of mercury. The method employs a container attached to an electrode subassembly having a vitreous tube surrounding a shell supported by an electrical lead. The method includes the step of orienting the container to reduce discharge of mercury directly toward the metallic shell. Another step is heating the container to open the container and discharge a mercury dose in the container.

According to still yet another further aspect of the invention, there is provided a method for releasing a dose of mercury. The method employs an electrode subassembly supporting a container with a vitreous sealing plug. The method includes the step of heating the vitreous sealing plug to defeat its sealing properties and open the container in order to discharge a mercury dose contained therein in proximity to the electrode subassembly.

Apparatus and methods of the foregoing type enhance the safety, reliability and effectiveness of mercury delivery in a discharge lamp. In one disclosed embodiment a dose of mercury is placed in a metallic cup that is sealed with an annular header that encircles a glass plug. This container can be welded to one of the legs of a hairpin-type electrical lead that supports the metallic shell of an electrode.

In this embodiment the axis of the container is skewed relative to the electrical lead. This orientation is chosen to direct the discharge of the mercury dose along a path between the metallic shell and the short glass tube of the electrode. This directs the discharging mercury towards the working region of the lamp without being blocked by the metallic shell and without excessively coating and potentially staining the shell. Being skewed, the bottom of the container moves toward the center and away from the pinch seal to reduce heat transfer during formation of the pinch seal. Also, the container is spaced sufficiently from the metallic shell to avoid premature opening when the shell is heated during bombardment.

In this embodiment, the container can be opened after the lamp is completely sealed using an inductive heater to heat the container and its contents. Several effects combine to open the container. First, the pressure inside the container increases as the heated mercury dose tends to vaporize and the inert gas gets hot. Also, the glass plug in the annular header can melt, fracture or be expelled by the pressure inside the container. In some cases, the header itself will be expelled even before the glass plug melts.

BRIEF DESCRIPTION OF THE DRAWINGS

The above brief description as well as other objects, features and advantages of the present invention will be more fully appreciated by reference to the following detailed description of illustrative embodiments in accordance with the present invention when taken in conjunction with the accompanying drawings, wherein.

DETAILED DESCRIPTION OF THE PREFERRED EMBODIMENTS

Figure 1:
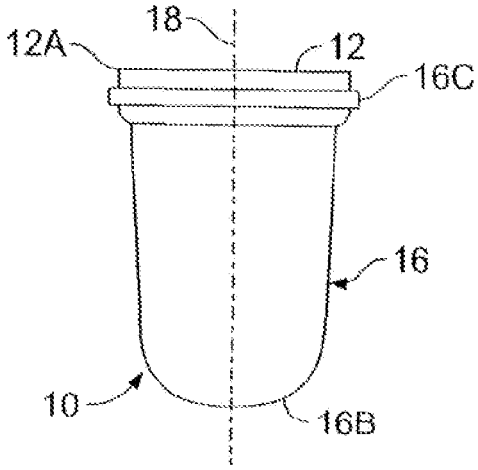
FIG. 1 is a side view of a container in accordance with principles of the present invention.
Figure 2:
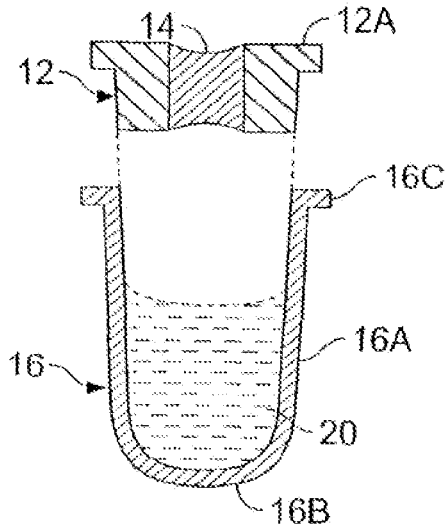
FIG. 2 is an exploded, cross-sectional view of the container of FIG. 1.

Referring to FIGS. 1 and 2 the illustrated container 10 includes a steel annular header 12 having an essentially cylindrical shape with an outer flange 12A. A central opening in header 12 is sealed with a vitreous plug 14. Plug 14 may be made by starting with glass particles that are poured into the central opening of header 12 and then heating both to fuse the glass either by melting or sintering to form a gas tight seal.

Plug 14 may be made from a lead free glass such as base glass GPC-890 (Corning 9013 equivalent) from Glass Processing Co., Inc.; Elmira Heights, N.Y. Such glass may have a softening point of 659° C., an anneal point of 462° C., and a strain point of 423° C., although these temperatures are just exemplary. Also in an exemplary embodiment, the glass had a thermal expansion of $89.0\times10^{-7}$ cm/cm/° C. In this embodiment the diameter of plug 14 is approximately 2 mm, although this diameter may vary in other embodiments.

Header 12 is designed to fit into the mouth of metallic cup 16. The cup 16 may be made of steel and may have a cylindrical sidewall 16A and a domed bottom 16B. The mouth of cup 16 is encircled by an outwardly projecting lip 16C shown undeformed in FIG. 2 and deformed by sealing and welding in FIG. 1. The mouth of cup 16 when sealed with header 12 is referred to herein as a sealed end, which is opposite the domed bottom 16B (this bottom also referred to as the opposite end). These two ends of container 10 are aligned along its longitudinal axis 18.

The cup 16 is shown partially filled with liquid mercury 20 although other embodiments may employ an amalgam or other substances for delivering mercury. In this embodiment the dose of liquid mercury is about 100 to 200 milligrams and fills approximately 40 to 80% of the volume inside container 10 when closed. In this embodiment container 10 has a length of about 5.5 mm and a diameter of about 4 mm, although these dimensions can vary depending upon the size of the lamp, the desired dose, wall thickness of the container, etc.

The free space inside container 10 unoccupied by mercury is filled with an inert gas such as argon. It will be appreciated that different size mercury doses may be employed and other inert gases can be substituted for the argon. In particular, the size of the dose of liquid mercury or other mercury delivering substance can be chosen depending on the size of the finished lamp, the desired efficiency, or other considerations. Also, the dose in the container 10 can be identified by color coding the glass plug 14 with appropriate dyes.

Figure 6:
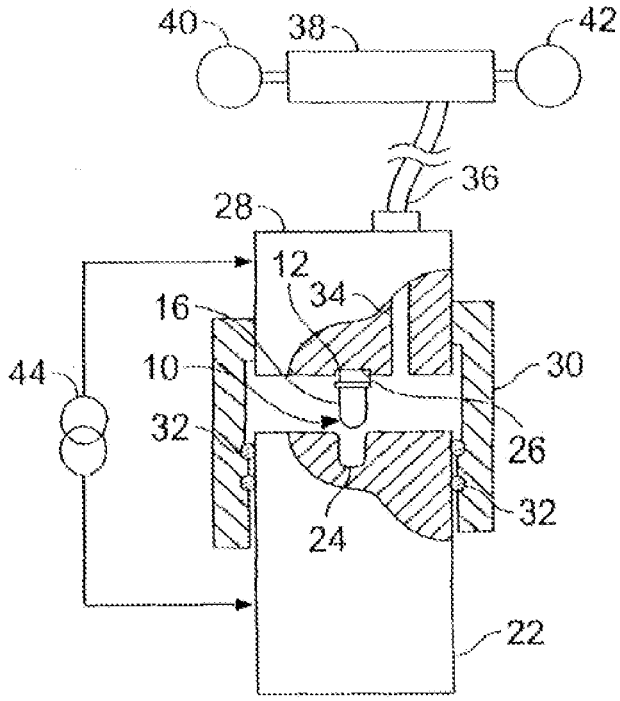
FIG. 6 is a schematic diagram of a mechanism for sealing the container of FIG. 1.

The header 12 and cup 16 of container 10 can be assembled using the apparatus of FIG. 6. Specifically, metal base 22 has a cavity 24 sized to closely receive cup 16. While only one recess 24 is illustrated, for practical embodiments multiple recesses will be employed so that containers 10 can be formed in batches. Cavity 24 has a beveled rim designed to create a seal in a manner to be described presently.

The cup 16 without header 12 is initially filled with the dose of mercury and placed in the cavity 24. Header 12 can be placed loosely in the mouth of cup 16 although in some embodiments header 12 will be placed in the recess 26 in metal press 28 and held there magnetically, adhesively, by a snug fit, or by suction created from a vacuum conduit (not shown). In instances where header 12 is initially placed in cup 16 recess 26 can be eliminated.

Press 28 is fitted with a rubber sleeve 30 fitted with a pair of O rings 32 that seals the sleeve to base 22 and still allows press 28 and sleeve 30 to move together relative to the base 22. Press 28 has an orifice 34 communicating through external line 36 to manifold 38. The manifold 38 is shown connecting to a switchable source of argon gas 40 and a switchable vacuum source 42. Sources 40 and 42 can be switched by solenoid operated valves (not shown). Press 28 and base 22 are shown separately connected to the two electrical leads of welding current source 44.

The press 28 and sleeve 30 can be removed from base 22 in order to install the cup 16 in cavity 24 with header 12 loosely fitted in the mouth of cup 16. Thereafter press 28 and sleeve 30 are reinstalled in the position illustrated in FIG. 6. Initially a vacuum is pulled using source 42 in order to evacuate air from cup 16. Next, the vacuum is ended and argon gas is supplied through source 40 to fill the free space between cup 16 and header 12.

Press 28 now descends to press header 12 into cup 16, but without allowing press 28 to make electrical contact with base 22. At the same time source 44 is energized to send welding current between header 12 and cup 16. Consequently, header 12 is welded to cup 16. The finished container of FIG. 1 shows some deformation in the lip 16C and header flange 12A caused by the press pressure and welding.

Figure 3:
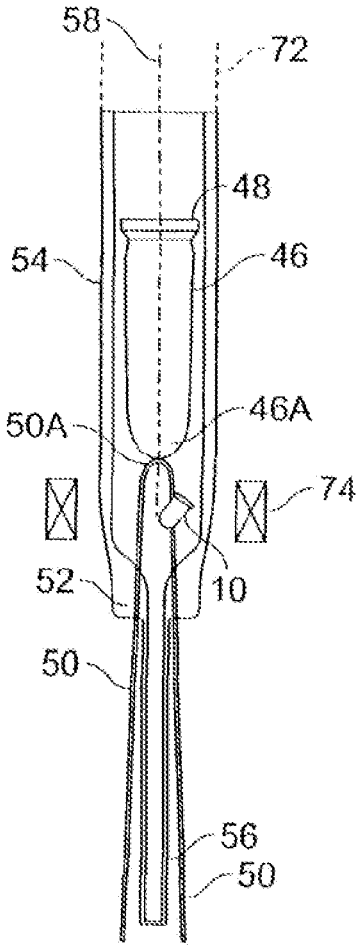
FIG. 3 is a side view of a lamp electrode in accordance with principles of the present invention and employing the container of FIG. 1.

Referring to FIGS. 1-3, metallic shell 46 has the shape of an open, hollow cylinder with a closed, domed, proximal end 46A. The inside of shell 46 is coated with a conventional emission enhancing coating. Non-conductive, annular, ceramic collar 48 is fitted in the open, distal end of shell 46 and is crimped in place. The proximal end 46A and the distal end (at collar 48) each lie along a central axis 58.

The proximal end 46A of shell 46 is supported at the hairpin turn 50A of supporting electrical lead 50. Lead 50 has a hairpin configuration lying in a central plane 60 containing central axis 58. Lead 50 has two legs that are embedded in a pinch seal 52 made in coaxial, vitreous, glass tube 54. A rear, coaxial, evacuation tubule 56 is fused at pinch seal 52 to communicate with the interior of tube 54. It will be appreciated that some electrodes will be assembled without an evacuation tube, in which case the pinch seal 52 will completely close one end of the tube 54. The combination of shell 46, lead 50 and glass tube 54 is herein referred to as an electrode subassembly.

Figure 4:
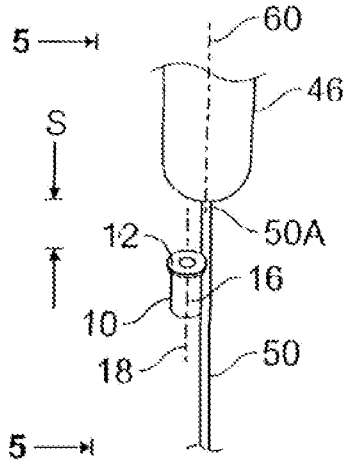
FIG. 4 is a detailed side view of a fragment of the shell, lead, and container of FIG. 3.
Figure 5:
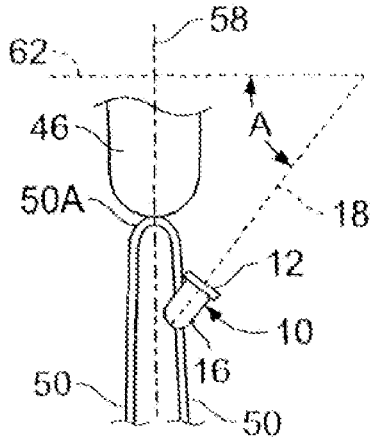
FIG. 5 is a side view taken along line 5-5 of FIG. 4.

The sidewall (sidewall 16A of FIG. 2) of cup 16 of container 10 is welded to one of the legs of lead 50. The longitudinal axis 18 of container 10 is skewed relative to lead 50 but as shown in FIG. 4 remains parallel to central plane 60. The amount of skewing is defined as shown in FIG. 5 by the angle A between the longitudinal axis 18 of container 10 and a plane 62 that is transverse to the central axis 58. Angle A will be chosen to avoid pointing the sealed end (the end with header 12) directly at shell 46. Instead, the sealed end will be directed toward a path that runs between shell 46 and glass tube 54. In addition, container 10 will be spaced from shell 46 by an offset distance S that is great enough to avoid premature opening of the container when the shell is heated during bombardment. On the other hand, offset distance S should not be so great as to bring container 10 too close to pinch seal 52, whose melted portions can become a large heat source during its formation. In addition, the skewed orientation of the longitudinal axis 18 of container 10 swings its domed bottom (bottom 16B of FIG. 1) inwardly and thus away from the inclined walls at the inside of the pinch seal 52.

In this embodiment angle A is about 25° and the offset distance S is about 2.5 mm, although these dimensions may be different in other embodiments, depending on the size of tube 54, the spacing between shell 46 and pinch seal 52, etc. Increasing the spacing between shell 46 and pinch seal 52 will separate container 10 from shell 46 and pinch seal 52, although excessive spacing will make supporting leads 50 relatively long and an unsteady support for the shell. A spacing of 18 mm between shell 46 and pinch seal 52 was found to be satisfactory for some embodiments. Also, there is an interplay between angle A and offset distance S, in that for relatively small offset distances S, angle A will be reduced. Good results can be expected if angle A is at most 85°.

Figure 7:
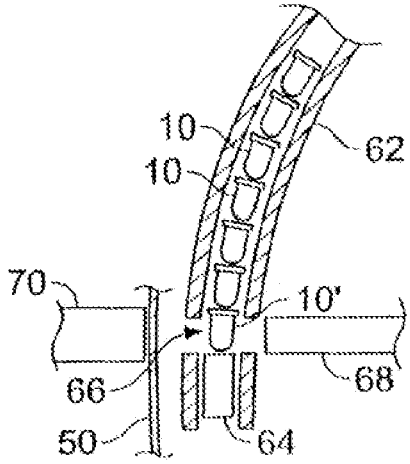
FIG. 7 is an apparatus for welding containers of the type shown in FIG. 1 to a lead of the type shown in FIG. 3.
Figure 8:
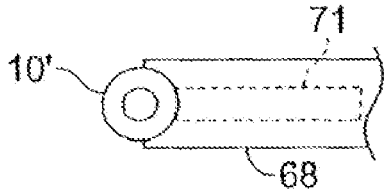
FIG. 8 is a side view of an implement shown in FIG. 7.

Referring to FIGS. 7 and 8, a column of the previously mentioned containers 10 are arranged end to end in plastic tube 62. Mounted in the downstream end of tube 62 is a magnet 64 designed to hold final container 10', which is located in the position furthest downstream in tube 62. The container 10' is aligned with a diametric through-hole 66 in tube 62.

A longitudinally reciprocatable probe 68 is aligned with hole 66. The distal end of probe 68 is curved to embrace the sidewall (sidewall 16A of FIG. 2) of container 10'. Probe 68 has an internal conduit 71 acting as a vacuum line for holding container 10' by suction, as shown in FIG. 8. Accordingly, probe 68 can extend into hole 66 to embrace container 10' and hold it by suction.

As probe 68 extends further it brings container 10' out of tube 62 and toward anvil 70. This apparatus may be used to weld container 10' to supporting electrical lead 50, which is shown positioned between tube 62 and anvil 70. Using anvil 70 as a backup, container 10' will be pressed by probe 68 against lead 50, which has the orientation shown in FIGS. 3-5. Lead 50 can be held in the desired position either manually or by automatic handling equipment (not shown).

Probe 68 and anvil 70 are conductive and are attached to a source (not shown) that drives a current between container 10' and lead 50 to weld them together. Thereafter, probe 68 can retract and, optionally, the vacuum in conduit 71 terminated so that container 10' is released from the probe. With probe 68 fully retracted from tube 62 the next container 10 will be pulled onto magnet 64 so that the foregoing process can repeat. This process can be quickly repeated so that a batch of containers 10 are welded to individual leads 50.

The foregoing process assumes that lead 50 is already welded to a finished shell (i.e., shell 46 of FIG. 3). Therefore, a glass tube (i.e., tube 54 of FIG. 3) will next be attached to the lead 50 by a pinch seal (with or without an evacuation tubule). Because container 10 is skewed in the manner previously described, it will be spaced from melted portions of the pinch seal (seal 52 of FIG. 3) to avoid excessive heating and premature opening of the container.

To facilitate an understanding of the principles associated with the foregoing apparatus, its operation will be briefly described in connection with the electrode of FIGS. 1-3. Shell 46 is normally provided from a manufacturer inside glass tube 54 supported on electrical lead 50, which is embedded in pinch seal 54. A pair of these short glass tubes 54 (typically one with and without evacuation tubules) are fused to either end of a longer discharge tube 72 (shown in phantom in FIG. 3). It will be appreciated that either one or both of the electrodes at either end of discharge tube 72 can be fitted with container 10. It will be assumed herein that only one electrode with a tubule 56 will be fitted with a container 10 in this exemplary assembly process.

The open evacuation tubule 56 will be used to partially evacuate the discharge tube 72. Next, a high voltage will be applied between the electrodes at the opposite ends of the discharge tube 72 to produce a stream of charged particles to heat the shells 46 and the discharge tube 72 in the usual fashion. As a result, any moisture in the lamp components will be driven into a vapor state. In addition, any emission-enhancing coating on the inside of shell 46, typically a mixture of metal carbonates or peroxides (or both), is heated and converted to the corresponding oxides (sintering).

The flux of charged particles flowing during this bombardment is concentrated primarily on electrode shell 46 since it has the greatest conducting surface. The offset distance S of container 10 is designed to moderate any temperature rise in container 10 to avoid premature opening.

After bombardment a greater vacuum will be pulled before loading an inert gas and then tipping off the evacuation tubule 56 to seal the discharge chamber.

An R. F. induction coil (74) looking that as I wounds in the may now be positioned on the outside of tube 54 around container 10 as shown in FIG. 3 to generate eddy currents in the container and possibly the mercury therein. As a result, container 10, mercury 20 (FIG. 2), and the inert gas over the mercury are heated to raise the pressure inside container 10. Also, thermal expansion of header 12 and cup 6 stresses the sealed joint between them. Furthermore, glass plug 14 is heated to its melting point.

As a result of the foregoing thermal effects, container 10 will open in one or more ways. In some cases, the plug 14 will melt and will be blown from header 12 by the pressure inside container 10. In some cases thermal stresses will break the weld between header 12 and cup 16 so header 12 will be ejected by the pressure inside container 10. In other cases plug 14 will fracture as result of thermal stresses, thereby opening container 10.

With container 10 now open, the mercury dose 20 will be discharged from the previously sealed end inwardly along the longitudinal axis 18. The axis 18 is oriented to prevent mercury discharge directly onto shell 46 in order to avoid staining the shell. Mercury vapor directly discharged onto shell 46 would tend to condense there since the shell was not heated and is therefore relatively cool. Instead, mercury vapor will travel along a path between shell 46 and tube 54. With the mercury dose thus discharged the lamp is finished and may be lit in the usual fashion. It has been determined that positioning container 10 behind shell 46 brings the container out of the path of the discharge current flowing when the lamp is lit. Positioning container 10 in this way avoids erosion of the container that blackens the glass and phosphors of tube 72.

Figure 9:
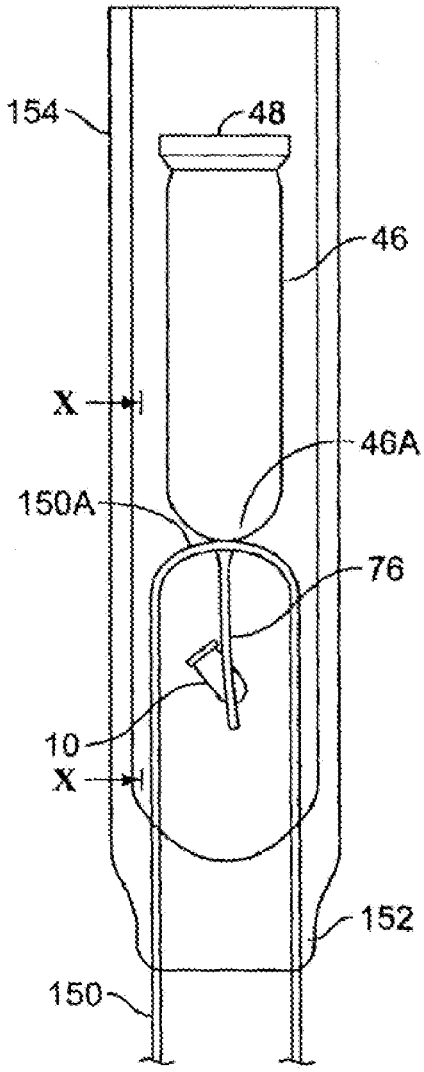
FIG. 9 is a side view of a lamp electrode that is an alternate to that of FIG. 3.
Figure 10:
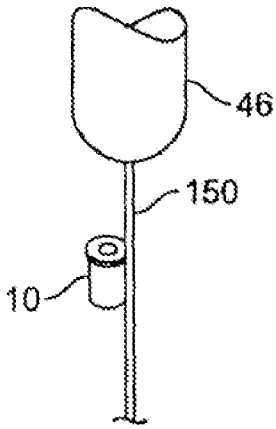
FIG. 10 is a fragmentary side view taken along line X-X of FIG. 9.

Referring to FIGS. 9 and 10, components corresponding to previously illustrated components bear the same reference numeral but increased by 100. Components identical to those previously illustrated bear the identical reference numerals. Previously illustrated shell 46 has its distal end 46A welded to the hairpin turn 150A of electrical lead 150, which is held in pinch seal 152 of the vitreous tube 154. Components 46, 150, and 154 are again referred to as an electrode subassembly.

In this embodiment cantilevered rod 76 is welded under the hairpin turn 150A and is aligned coaxially with shell 46. In this embodiment, rod 76 is a metal wire. Rod 76 reaches about halfway to pinch seal 152 and the side wall of previously mentioned container 10 is welded to rod 76 near its free end. Accordingly, container 10 is indirectly attached to electrode subassembly 46/150/154 by means of rod 76. Also, the axis of container 10 is canted to intersect a plane transverse to the previously mentioned central axis of shell 46 at an angle similar to that previously described in connection with FIG. 3.

Figure 11:
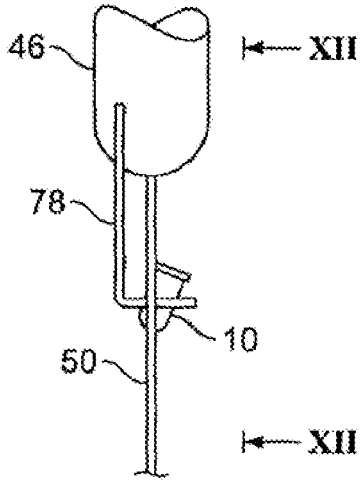
FIG. 11 is a side view of a portion of an electrode that is an alternate to that of FIG. 10.
Figure 12:
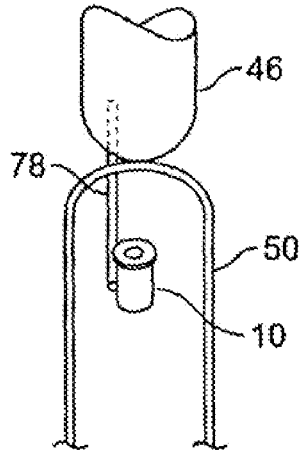
FIG. 12 is a side view taken along line XII-XII of FIG. 11.

Referring to FIGS. 11 and 12, previously mentioned shell 46 and electrical lead 50 are welded together as already described in connection with FIG. 3. To simplify this illustration, the glass tube encompassing shell 46 was left out.

This embodiment differs from that of FIG. 3 in that the previously mentioned container 10 is indirectly connected to shell 46 via rod 78. In this embodiment rod 78 is an L-shaped wire with its long segment welded to the side of shell 46. The side wall of container 10 is welded to the short segment of rod 78. If the two legs of electrical lead 50 are deemed to lie at the three o'clock and nine o'clock positions, the rod 78 will be deemed attached to shell 46 at the half past 10 o'clock position. The short segment of rod 78 extends perpendicular to the legs of electrical lead 50 and is offset to provide clearance for container 10, allowing the container to be located centrally between the legs of electrical lead 50.

Figure 13:
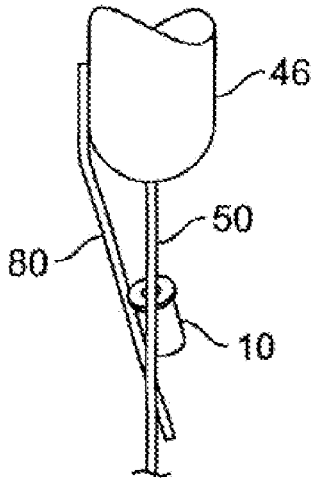
FIG. 13 is a side view of a portion of an electrode that is an alternate to that of FIGS. 10 and 11.

Referring to FIG. 13, previously mentioned shell 46 and electrical lead 50 are welded together as already described in connection with FIG. 3. To simplify this illustration, the glass tube encompassing shell 46 was left out.

This embodiment differs from that of FIG. 3 in that the previously mentioned container 10 is indirectly connected to shell 46 via cantilevered rod 80. In this embodiment rod 80 is a metal wire with an obtuse bend. One end of rod 80 is welded to the side of shell 46 at the 12 o'clock position (assuming that the legs of electrical lead 50 lie at the three o'clock and nine o'clock positions). The side wall of container 10 is welded near the free end of rod 80. Also, the axis of container 10 is canted to intersect a plane transverse to the previously mentioned central axis of shell 46 at an angle similar to that previously described in connection with FIG. 3. It will be noted that the axis of container 10 is not parallel to either segment of rod 80.

Figure 14:
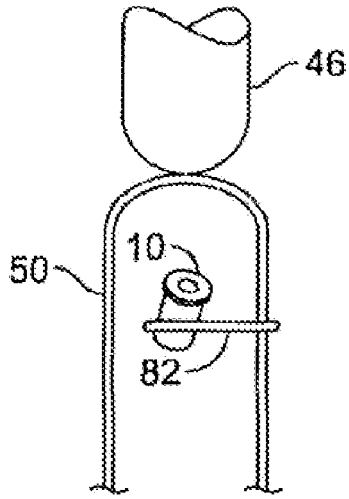
FIG. 14 is a side view of a portion of an electrode that is an alternate to those previously illustrated.

Referring to FIG. 14, previously mentioned shell 46 and electrical lead 50 are welded together as already described in connection with FIG. 3. To simplify this illustration, the glass tube encompassing shell 46 was left out.

This embodiment differs from that of FIG. 3 in that the previously mentioned container 10 is indirectly connected to shell 46 via cantilevered rod 82. In this embodiment rod 82 is a metal wire having one of its ends welded to one of the legs of electrical lead 50. Rod 82 is transverse to the central axis of shell 46 and intersects the plane containing the two legs of lead 50 at an angle of about 45°. The side wall of container 10 is welded at the free end of rod 82, but not parallel to the central axis of shell 46. The axis of container 10 is canted to intersect a plane transverse to the previously mentioned central axis of shell 46 at an angle similar to that previously described in connection with FIG. 3.

Figure 15:
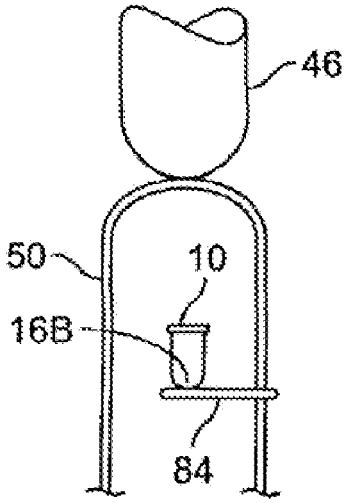
FIG. 15 is a side view of a portion of an electrode that is an alternate to those previously illustrated.

Referring to FIG. 15, previously mentioned shell 46 and electrical lead 50 are welded together as already described in connection with FIG. 3. To simplify this illustration, the glass tube encompassing shell 46 was left out.

This embodiment differs from that of FIG. 3 in that the previously mentioned container 10 is indirectly connected to shell 46 via cantilevered rod 84. In this embodiment rod 84 is a metal wire having one of its ends welded to one of the legs of electrical lead 50. Rod 84 is transverse to the central axis of shell 46 and parallel to the plane containing the two legs of lead 50. The bottom 16B of container 10 is welded at the free end of rod 84, substantially coaxial with the central axis of shell 46.

Figure 16:
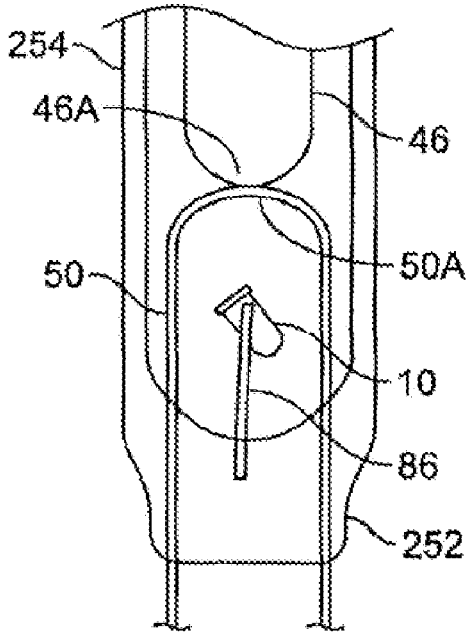
FIG. 16 is a side view of a portion of an electrode that is an alternate to those previously illustrated.

Referring to FIG. 16, components corresponding to previously illustrated components bear the same reference numeral but increased by 200. Components identical to those previously illustrated bear the identical reference numerals. Previously illustrated shell 46 has its distal end 46A welded to the hairpin turn 50A of electrical lead 50, which is held in pinch seal 252 of the vitreous tube 254. Components 46, 50, and 254 are referred to as an electrode subassembly.

This embodiment differs from that of FIG. 3 in that the previously mentioned container 10 is indirectly connected to shell 46 via cantilevered rod 86. In this embodiment rod 86 is a metal wire and one of its ends was embedded in pinch seal 252 during seal formation. The side wall of container 10 is welded at the free and of rod 86. Since rod 86 is coaxial with shell 46 and coplanar with the two legs of lead 50, container 10 is offcentered and thus positioned close the inside surface of tube 254. Also, the axis of container 10 is canted relative to rod 86 to intersect a plane transverse to the previously mentioned central axis of shell 46 at an angle similar to that previously described in connection with FIG. 3.

It is appreciated that various modifications may be implemented with respect to the above described embodiments. In some embodiments the container may have a conical, hemispherical, polyhedral, or other shape. In some cases a header will be eliminated and a glass plug will be installed directly in the mouth of a cup. In still other embodiments, the container will be made with a weakened or frangible region that will tend to open when heated and will then be considered the sealed end. In addition, containers may be fabricated without a vitreous plug. Furthermore, multiple containers may be mounted on a supporting electrical lead; for example, on the same or on opposite legs of a hairpin-type lead. Moreover, some containers may be mounted to a supporting electrical lead indirectly through a supporting strut, brace, bracket, or other structure. The container's size, wall thickness, capacity, and fabrication materials can be varied depending upon the desired strength, capacity, thermal stability, structural integrity, etc.

Obviously, many modifications and variations of the present invention are possible in light of the above teachings. It is therefore to be understood that within the scope of the appended claims, the invention may be practiced otherwise than as specifically described.

The invention claimed is:

1. A lamp electrode adapted to deliver mercury during an assembly process, comprising:

an electrode subassembly including:

(a) a metallic shell having a proximal end and a distal end each lying along a central axis, (b) a supporting electrical lead attached to the proximal end of said metallic shell, and (c) a vitreous tube fused onto said electrical lead to surround said shell; and a container having a sidewall, a sealed end, and a longitudinal axis, said container containing a substance for delivering mercury upon heating of said container, said container being attached to said electrode subassembly and spaced proximally from said metallic shell, the longitudinal axis of the container being skewed to avoid parallelism relative to said central axis in order to orient said container in a direction to reduce discharge of mercury directly toward said metallic shell.

2. A lamp electrode according to claim 1 wherein said sealed end is prone to opening upon heating of said container.

3. A lamp electrode according to claim 1 wherein said container is spaced proximally from said metallic shell by an offset distance in order to avoid premature mercury delivery from said container upon heating of said shell.

4. A lamp electrode according to claim 1 wherein the sidewall of said container is attached to said electrical lead.

5. A lamp electrode according to claim 1 wherein said electrode subassembly comprises a rod attached to said shell, said container being attached to said rod.

6. A lamp electrode according to claim 1 wherein said container contains in addition to the mercury delivering substance an inert gas.

7. A lamp electrode according to claim 1 wherein said container has opposite said sealed end an opposite end that is further from said shell than said sealed end, said sealed end being prone to opening upon heating of said container.

8. A lamp electrode according to claim 7 wherein said sealed end of said container is further from said central axis than the opposite end of said container.

9. A lamp electrode according to claim 7 wherein said longitudinal axis of said container intersects a plane transverse to the central axis at an acute angle of at most 85°.

10. A lamp electrode according to claim 1 wherein said container comprises:

a cup; and a annular header with a flange sealingly attached to said cup, said cup having a mouth with an outwardly projecting lip and a domed bottom, said sidewall being shaped substantially cylindrically.

11. A lamp electrode adapted to deliver mercury during an assembly process, comprising:

an electrode subassembly including:

(a) a metallic shell having a proximal end and a distal end each lying along a central axis, (b) a supporting electrical lead attached to the proximal end of said metallic shell, and (c) a vitreous tube fused onto said electrical lead to surround said shell; and a container containing a substance for delivering mercury upon heating of said container, said container having a sealed end with a vitreous plug, said container being attached (1) to the supporting electrical lead or (2) to a cantilevered metal rod attached to either the metallic shell or the supporting electrical lead, at least a portion of said cantilevered metal rod being placed past the proximal end of said metallic shell, said container being spaced proximally from said metallic shell.

12. A lamp electrode according to claim 11 wherein said sealed end is prone to opening upon heating of said container.

13. A lamp electrode according to claim 11 wherein said plug comprises lead-free glass that is prone to melting upon heating of said container.

14. A lamp electrode according to claim 11 wherein said plug comprises glass that is prone to one or more of melting, fracturing, or dislodging upon heating of said container.

15. A lamp electrode according to claim 11 wherein said plug is color coded to indicate the quantity of mercury delivering substance in said container.

16. A lamp electrode according to claim 11 wherein said container has a metallic cup that is attached to said electrical lead.

17. A lamp electrode according to claim 11 wherein said container has opposite said vitreous plug an opposite end that is further from said shell than said sealed end.

18. A lamp electrode according to claim 11 wherein said container comprises:

a cup and an annular header sealingly attached to said cup, said vitreous plug being centrally mounted in said header.

19. A lamp electrode according to claim 18 wherein said header has a flange, said cup having a mouth with an outwardly projecting lip and a domed bottom, said sidewall being cylindrically shaped.

* * * * *